United States Patent [19]

Ogura

[11] 4,012,897

[45] Mar. 22, 1977

[54] METHOD AND APPARATUS FOR TWISTING YARNS

[75] Inventor: Junshiro Ogura, Tokyo, Japan

[73] Assignee: Ogura Jewel Industry Co., Ltd., Tokyo, Japan

[22] Filed: Feb. 27, 1975

[21] Appl. No.: 553,819

[30] Foreign Application Priority Data

Mar. 2, 1974 Japan ..... 49-23768

[52] U.S. Cl. ..... 57/77.4; 57/77.42; 57/157 TS

[51] Int. Cl.[2] ..... D02G 1/08

[58] Field of Search ..... 57/77.4, 77.42, 156, 57/157 TS

[56] References Cited

UNITED STATES PATENTS

| | | | |
|---|---|---|---|
| 2,943,433 | 7/1960 | Van Dijk | 57/77.42 X |
| 3,394,540 | 7/1968 | Bentov | 57/77.4 X |
| 3,635,008 | 1/1972 | Guy | 57/77.4 |
| 3,842,582 | 10/1974 | Richter | 57/77.4 |

*Primary Examiner*—Richard C. Queisser
*Assistant Examiner*—Charles Gorenstein

[57] ABSTRACT

Method and apparatus for twisting yarns for crimping purposes, wherein a yarn to be crimped is passed through a pair of opposingly rotating twisting discs in contact with circumferential faces thereof. The two twisting discs are disposed in small gap relation with each other for pressingly gripping the yarn therebetween and are rotating about the respective rotational axes which are non-parallel to each other and inclined in opposite directions relative to the length of input yarn with the respective circumferential faces turned toward a yarn gripping position from opposite sides thereof.

2 Claims, 5 Drawing Figures

METHOD AND APPARATUS FOR TWISTING YARNS

BACKGROUND OF THE INVENTION

This invention relates to a method and apparatus for twisting yarns for crimping purposes, particularly yarns of thermoplastic synthetic resin fiber.

The currently used yarn twisters are largely classified into a spindle type and a friction type. The spindle type yarn twisting has an inherent technical problem that the spindle has to be rotated at an extremely high speed in order to attain satisfactory productivity. On the other hand, the friction type twisting has also a drawback in that it is necessary to maintain the input yarn under high tension to impart sufficient twists to the yarn.

SUMMARY OF THE INVENTION

It is therefore an object of the present invention to provide a method and apparatus for twisting yarns, which will eliminate the difficulties which are encountered in the conventional type yarn twisting as mentioned above.

It is a more particular object of the present invention to provide a method and apparatus for twisting yarns, which are capable of imparting twists efficiently at high speed to a yarn which is fed under extremely low tension.

It is another object of the present invention to provide a method and apparatus for twisting yarns, wherein the positioning of the yarn to be crimped is very easy.

It is a further object of the present invention to provide a method and apparatus for twisting yarns, which is capable of imparting an increased number of twists per unit length of the yarn to attain a high stretch as has been difficult to attain by the conventional counterparts.

The method and apparatus of the present invention, in order to achieve the afore-mentioned objects, employ a pair of opposingly rotating twisting discs for passing therethrough a yarn to be crimped, in contact with the circumferencial faces of the discs. The paired twisting discs and disposed in small gap relation with each other for pressingly gripping the yarn therebetween and are rotating about the respective rotational axes which are non-parallel to each other and inclined in opposite directions relative to the length of input yarn with the respective circumferencial faces turned toward a yarn gripping position from opposite sides.

The above-mentioned two twisting discs are driven to rotate at the same or different circumferencial speeds. However, where the discs are rotated at different circumferencial speeds, it is preferable to provide a yarn guide means on either side of a yarn gripping position of the discs where the yarn undergoes twisting for urging the yarn toward the gripping position as otherwise the yarn would tend to escape therefrom as will be discussed in greater detail hereinlater.

The above and other objects, features and advantages of the invention will become clear from the following particular description of the invention and appended claims, taken in conjunction with the accompanying drawings which show by way of example preferred embodiment of the invention.

Figure 1:
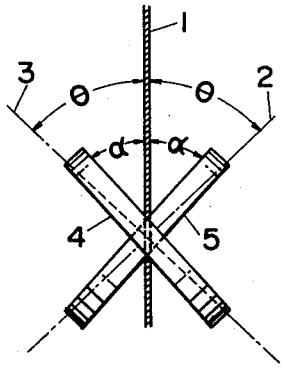
FIG. 1 is a front view of twisting discs employed in the present invention.

PARTICULAR DESCRIPTION OF THE INVENTION:

Referring to the accompanying drawings and first to FIG. 1, a yarn 1 to be crimped is fed to and passed through a pair of opposingly rotating twisting discs 4 and 5 which have nonparallel rotational axes 2 and 3, respectively. The two twisting discs 4 and 5 are disposed in small gap relation with each other and have the respective rotational axes 2 and 3 inclined in opposite direction at an angle of $\theta^{\circ}$ with respect to the input twisting yarn 1. The paired twisting discs 4 and 5 which are of the same outer diameter are rotated in the same direction as seen from the yarn feeding side so that the circumferencial faces of the two twisting discs are turned at a uniform speed toward the yarn gripping position from opposite sides thereof. In other words, the yarn 1 is twisted while being pressingly gripped between the two twisting discs 4 and 5 which are rotated in the same direction but have the respective circumferencial faces turned toward the yarn gripping position in opposite directions. The yarn 1 which has undergone twisting is advanced automatically in the downward direction as seen in FIG. 1 since the two twisting discs 4 and 5 are inclined at an angle of $\theta$ relative to the length of the input yarn 1. In FIG. 1, the reference character $\alpha$ denotes a complementary angle of $\theta$.

In this instance, if there should occur a difference in the circumferencial speeds of the two twisting discs, the yarn 1 is carried away from the normal yarn gripping position by a disc which has a greater circumferencial speed. In order to avoid this, it is preferable to employ, in combination with the twisting discs 4 and 5, suitable control means for adjusting the circumferencial speed of one or both of the twisting discs 4 and 5 upon detection of a positional deviation of the yarn 1.

Figure 2:
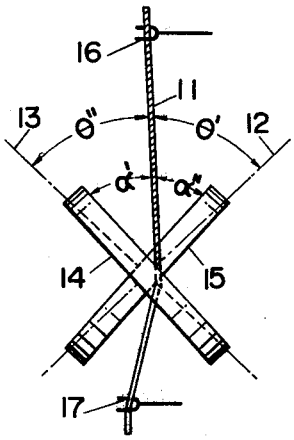
FIG. 2 is a front view of twisting discs employed in another embodiment of the invention.
Figure 3:
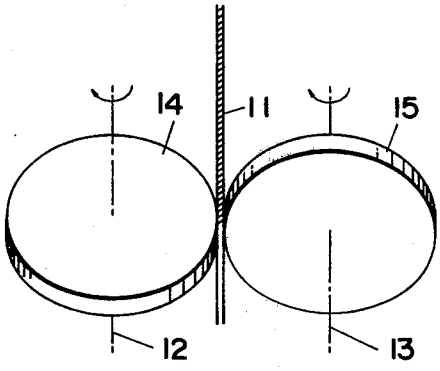
FIG. 3 is a side view of the twisting discs of FIG. 2.
Figure 4:
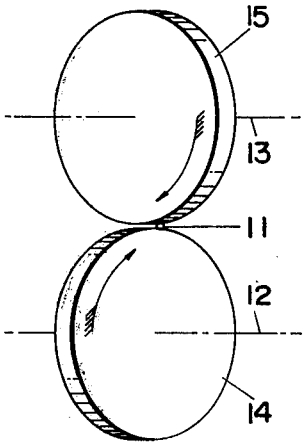
FIG. 4 is a plan view of the twisting discs of FIG. 2.
Figure 5:
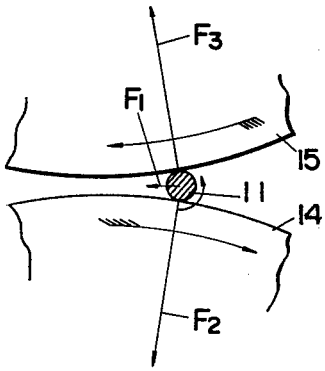
FIG. 5 is an enlarged fragmentary view of the twisting discs of FIG. 4.

Referring to FIGS. 2 through 5 which show a more preferred embodiment of the invention, a pair of rotary twisting discs 14 and 15 are similarly disposed on opposite sides of the yarn passage in small gap relation with each other for pressingly gripping therebetween a yarn 11 which is continuously fed thereto. The rotational axes of the two twisting discs 14 and 15 are disposed non-parallel to each other and inclined likewise at angles of $\theta'$ and $\theta''$ relative to the length of the input yarn 1, respectively. Similarly to the embodiment shown in FIG. 1, the twisting discs 14 and 15 are rotated about the respective rotational axes at different circumferencial speeds but in the same direction as seen from the yarn feeding side (clockwise in FIG. 4). More particularly, the yarn twisting circumferencial faces of the two discs 14 and 15 are turned in opposite directions toward the yarn gripping position at speeds which are slightly different from each other for imparting twists to the yarn 11. In this embodiment, the twisting discs 14 and 15 have the same diameter but one for example, the disc 14 is driven to rotate at a greater angular velocity than the other. However, if desired, one of the twisting discs may be fabricated in a greater diameter and driven to rotate at the same angular velocity. In FIG. 2, the reference numerals 16 and 17 indicate an input yarn guide and an output yarn guide, respectively. The output yarn guide 17 is so positioned as to urge the yarn 11 toward the meeting point of the two twisting discs 14 and 15 (to the left in FIG. 2). However, this yarn urging role may be taken over by the input yarn guide 16, if desired, by locating the same in a suitable position.

With the twister construction as described above, the yarn positioning prior to the twisting operation is extremely easy. More particularly, the yarn 11 is simply placed in a small gap between the two discs 14, from the righthand side of the discs 14 and 15 in FIGS. 2, 4 and 5 or from the front side in FIG. 3, in contact with the circumferencial faces of the two discs. Thereupon, the two discs 14 and 15 are started to rotate in the same direction (clockwise in FIG. 4) to have the circumferencial faces of the two discs turned toward the yarn gripping position substantially from opposite sides thereof. As a result, the yarn 11 undergoes twisting and the twisted yarn portions are advanced automatically away from the twisting discs 14 and 15 or downwardly in FIGS. 2 and 3. In this instance, the yarn 11 tends to be carried away by the discs 14 which, as mentioned hereinbefore, is rotating at a slightly greater circumferencial speed than the other disc 15. More particularly, the yarn 11 tends to escape to the right in FIGS. 2, 4 and 5 and in a downward direction in FIG. 3. This tendency of the yarn 11, however, is suppressed by the action of the output yarn guide 17 which is positioned beyond the yarn gripping point, to the left of the yarn gripping point in FIG. 2. Thus, the yarn 11 is transferred in a stabilized state. Should a difficulty be found in the movement of the yarn 11, it can be remedied simply by adjusting the position of the output yarn guide 17 or by adjusting the circumferencial speed or inclination of the twisting disc 14 or 15.

In the embodiment shown in FIG. 1, the yarn 1 is twisted substantially at the geometrical meeting point of the two discs 4 and 5. However, the yarn 11 of the embodiment of FIGS. 2 to 5 undergoes twisting slightly ahead of the geometrical meeting point of the two discs due to the difference in circumferencial speed of the two discs 14 and 15.

In this manner, the yarn 11 is twisted by the cooperative action of the rotating discs 14 and 15. In this instance, a small force $F_1$ which is imposed on the yarn 11 by the output yarn guide 17 is transformed into greater contacting forces $F_2$ and $F_3$ to allow the twisting operation to be carried out with remarkably improved efficiency. The output yarn guide 17 also has the action of assisting untwisting of the yarn 11.

It will be understood from the foregoing description that, according to the invention, it is very easy to position the yarn on the twister, and there is almost no possibility of yarn breakages or fluffing due to frictional variations caused by a lubricant or the like as the yarn is almost completely free from slippage, thus allowing to produce crimped yarns of uniform quality. Furthermore, since the yarn can be twisted at an extremely high speed and in secure contact with the twisting discs to improve the productivity to a considerable degree by determining a suitable ratio of the outer diameter of the yarn to the outer diameter of the twisting disc. As the yarn may be fed under reduced tension, it is possible to impart an increased number of twists per unit length of the yarn to attain a high stretch which has thus far been considered difficult or impossible. It will also be understood that the method and apparatus of the invention is not limited to a particular kind of yarn and can deal almost any kind of yarns.

What is claimed is:

1. A method of twisting yarns, comprising the steps of passing a yarn to be crimped through a pair of opposingly rotating twisting discs in contact with circumferencial faces thereof, said twisting discs being disposed in small gap relation with each other, said gap being smaller than the yarn diameter, for pressingly gripping said yarn therebetween and rotating about the respective rotational axes which are non-parallel to each other and inclined at a predetermined angle in opposite directions relative to the length of input yarn to have the respective circumferencial faces turned toward a yarn gripping position from opposite sides thereof, rotating said twisting discs at slightly different circumferencial speeds, and urging said yarn toward said yarn gripping position.

2. An apparatus for twisting yarns, comprising a pair of opposingly rotatable twisting discs disposed in small gap relation with each other for pressingly gripping between the circumferencial faces thereof a yarn to be crimped, said gap being smaller than the diameter of the yarn, and rotatable about the respective rotational axes which are non-parallel to each other and inclined at a predetermined angle in opposite directions relative to the length of input yarn to have the respective circumferencial faces turned toward a yarn gripping position from opposite sides thereof, said twisting discs being driven to rotate at slightly different circumferencial speeds, and guide means for urging said yarn toward said yarn gripping position.

* * * * *